US006845754B2

(12) United States Patent
Pecheny et al.

(10) Patent No.: US 6,845,754 B2
(45) Date of Patent: Jan. 25, 2005

(54) FUEL INJECTION DEVICE HAVING INDEPENDENTLY CONTROLLED FUEL COMPRESSION AND FUEL INJECTION PROCESSES

(75) Inventors: Vladimir Pecheny, Arlington Heights, IL (US); Titus J. Iwaszkiewicz, Woodridge, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/357,966

(22) Filed: Feb. 4, 2003

(65) Prior Publication Data

US 2004/0149264 A1 Aug. 5, 2004

(51) Int. Cl.[7] ..... F02M 37/04
(52) U.S. Cl. ..... 123/446; 239/88; 123/500
(58) Field of Search ..... 123/446, 500, 123/501, 467, 458; 239/88–96

(56) References Cited

U.S. PATENT DOCUMENTS 4,440,132 A * 4/1984 Terada et al. ..... 123/446
5,413,076 A * 5/1995 Koenigswieser et al. ... 123/446
5,460,329 A 10/1995 Sturman
5,463,996 A * 11/1995 Maley et al. ..... 123/446
5,597,118 A 1/1997 Carter, Jr. et al.
5,697,342 A * 12/1997 Anderson et al. ..... 123/446
5,722,373 A 3/1998 Paul et al.
5,862,792 A * 1/1999 Paul et al. ..... 123/446
6,029,628 A 2/2000 Oleksiewicz et al.
6,227,166 B1 * 5/2001 Mack ..... 123/446
6,412,705 B1 * 7/2002 Desai et al. ..... 239/88
6,422,209 B1 * 7/2002 Mattes ..... 123/467
6,526,943 B2 * 3/2003 Augustin ..... 123/446
6,598,591 B2 * 7/2003 Lewis ..... 123/467

* cited by examiner

*Primary Examiner*—Carl S. Miller
(74) *Attorney, Agent, or Firm*—Dennis Kelly Sullivan; Susan L. Lukasik; Jeffrey P. Calfa

(57) ABSTRACT

A fuel injection device (26) for an internal combustion engine (10) has a fuel inlet (40) and a fuel outlet (42). A plunger (58) is operable within a fuel pumping chamber (50) for forcing pressure-amplified fuel to open and pass through an outlet control valve (56) at the outlet. A ("fast-acting") control valve (64) operates in timed relation to the engine cycle to allow control fluid from an oil rail (34) to force valve (56) closed when fuel is not to be injected and to disallow control fluid from forcing valve (56) closed when fuel is to be injected. A ("slow-acting") control valve (72) is selectively operable in timed relation to the engine cycle to disallow control fluid from acting on plunger (58) when fuel is not to be injected, but allow control fluid to act on the plunger to force injection when control valve (72) is disallowing control fluid from forcing control valve (56) closed.

10 Claims, 12 Drawing Sheets

FUEL INJECTION DEVICE HAVING INDEPENDENTLY CONTROLLED FUEL COMPRESSION AND FUEL INJECTION PROCESSES

FIELD OF THE INVENTION

This invention relates generally to internal combustion engines having combustion chambers into which fuel is injected, and to devices and methods for fuel injection. More particularly, the invention relates to engines, devices, and methods where fuel is directly injected into combustion chambers under amplified injection pressure in properly timed relation to engine operation to mix with air and be ignited by force of compression exerted on the mixture by pistons that reciprocate within engine cylinders forming the combustion chambers.

BACKGROUND OF THE INVENTION

A known electronic engine control system comprises a processor-based engine controller that processes data from various sources to develop control data for controlling certain functions of the engine, including fueling of the engine by injection of fuel into engine combustion chambers. Control of engine fueling extends to both the duration of an injection of fuel and the timing of fuel injection so that the control system thereby sets both the amount of fuel injected and the time at which injection occurs during an engine cycle.

A known diesel engine that powers a motor vehicle has an oil pump that delivers oil under pressure to an oil rail serving electric-actuated fuel injection devices, or simply fuel injectors, that use oil from the oil rail to force injections of fuel. The pressure at the oil rail is sometimes referred to as injector control pressure, or ICP, and that pressure is under the control of an appropriate ICP control strategy that is an element of the overall engine control strategy implemented in the engine control system.

Certain known fuel injection devices contain electric-actuated valves that control the delivery of oil that has been pumped to an oil rail at ICP to pistons that force fuel into the engine combustion chambers via plungers. Examples are found in U.S. Pat. Nos. 5,460,329; 5,597,118; and 5,722,373.

Another example of such a device is disclosed in commonly owned U.S. Pat. No. 6,029,628. The device has a plunger that is displaced within a pumping chamber by oil from the oil rail to force fuel from the pumping chamber. The oil pressure elevates the fuel pressure within the device to a magnitude large enough for forcing a normally closed control valve at an outlet of the device to open. When that outlet control valve opens, the fuel pressure forces fuel through the outlet and into the corresponding combustion chamber.

SUMMARY OF THE INVENTION

Briefly, the present invention relates to a new and improved fuel injection device in which the application of ICP oil to a plunger that is operable within a pumping chamber to amplify the pressure of fuel to be injected into a combustion chamber from a volume under the plunger is controlled independently of the application of ICP to an outlet control valve at the outlet of the device. In a preferred embodiment, the outlet control valve comprises a needle with which a needle-lock piston is associated. The application of ICP oil to a needle-lock piston control chamber where the oil acts on a first effective area of the needle-lock piston is controlled by an electric-actuated "fast-acting" control valve. A second effective area of the needle-lock piston that is opposite the first effective area and not exposed to the oil is communicated to the pumping chamber. Hydraulic forces acting on the respective effective areas act in opposition to each other. The respective effective areas are proportioned such that application of ICP oil to the first effective area always forces the outlet valve needle to close the outlet, even when fuel pressure acting on the second effective area is being amplified by the action of ICP oil on the plunger to a pressure that is a multiple of ICP. When the application of ICP oil to the first effective area is discontinued, the amplified fuel pressure forces the needle to open the outlet so that fuel can be forced from the pumping chamber and out the open outlet.

A "slow-acting" control valve controls the application of ICP oil to the plunger. When that valve discontinues the application of ICP oil to the plunger, the plunger is enabled to upstroke within the pumping chamber for filling the pumping chamber with fuel from a fuel inlet of the device thereby creating a charge of fuel for an ensuing injection. When the "slow-acting" control valve once again applies ICP oil to the plunger, the plunger exerts amplified pressure on the fuel charge in the pumping chamber. With the "fast-acting" control valve causing ICP oil to be applied to the needle-lock piston control chamber until the fuel pressure has been suitably amplified by the plunger, fuel injection will not occur until suitable fuel pressure amplification has been achieved.

Once suitable fuel pressure amplification has been achieved, the "fast-acting" control valve is operated to discontinue the application of ICP oil to the needle-lock piston control chamber. The amplified fuel pressure promptly forces the needle to open the fuel outlet, and the continued application of ICP oil to the plunger causes the plunger to downstroke, forcing fuel from the pumping chamber, past the open needle, and through the outlet, thereby creating an injection of fuel from the device.

The injection is terminated by operating the "fast-acting" control valve to cause ICP oil to once again be applied to the needle-lock piston control chamber. As the needle travels toward closure of the outlet, fuel from the pumping chamber continues to be delivered at amplified pressure.

By providing separate control valves for controlling the application of ICP oil to the plunger and to the needle-lock piston that controls the needle, the design of each control valve can be optimized for the particular function that it performs. In particular, the "slow-acting" control valve can have a larger open flow area and need not operate as fast as the "fast-acting" control valve. By allowing the "slow-acting" valve to fully open before start of injection, fuel is amplified to a suitable pressure before start of injection, and once injection starts, the entire injection can take place while fuel pressure is maintained substantially at the amplified pressure because the larger open flow area imposes relatively small restriction to flow of oil from the oil rail to the plunger. The "slow-acting" control valve can, for example, be operated by an electro-hydraulic actuator, either rotary or linear, in the case of either a "camless" or "non-camless" engine, or from the camshaft mechanism of a "non-camless" engine. The "slow-acting" control valve can, when appropriate, be placed inside the oil rail, rather than being incorporated in the fuel injection device that is assembled to the oil rail.

The "fast-acting" control valve enables the needle to quickly open and close even with the fuel at amplified pressure. The combination of precise control over a valve that opens and closes the needle very quickly while pressure of fuel being injected is maintained substantially at an amplified pressure, can provide greater precision in both quantity of fuel injected and timing of injections. Furthermore, multiple injections may be made from a single charge of fuel in the pumping chamber by multiple closing and openings of the "fast-acting" valve while the "slow-acting" valve remains open.

Accordingly a generic aspect of the invention relates to a device for injecting fuel into a combustion chamber of an internal combustion engine fuel. The device comprises a fuel inlet through which fuel is introduced into the device and a fuel outlet through which fuel is injected from the device. A first control valve is operable selectively to open the fuel outlet for allowing fuel to be injected from the device and to close the fuel outlet for disallowing fuel from being injected from the device. A plunger is operable within a pumping chamber that has fluid communication with both the fuel inlet and the first control valve for executing a charge stroke to fill the pumping chamber with fuel from the fuel inlet while the first control valve is closed, and thereafter executing a discharge stroke that forces fuel from the pumping chamber to open the first control valve to the fuel outlet and be injected from the fuel outlet.

The device also has a control fluid inlet at which control fluid is introduced into the device. A second control valve is operable selectively to allow control fluid to force the first control valve closed for disallowing injection of fuel from the fuel outlet and to disallow control fluid from forcing the first control valve closed for allowing injection of fuel from the fuel outlet. A third control valve is operable selectively to allow control fluid to force the plunger to execute a discharge stroke while the second control valve is disallowing control fluid from forcing the first control valve closed and to disallow control fluid from preventing execution of a charge stroke.

Another generic aspect relates to an internal combustion engine comprising combustion chambers within which fuel is compressed and combusted to power the engine and fuel injectors for injecting fuel into the combustion chambers. Each fuel injector comprises a fuel inlet through which fuel is introduced into the fuel injector and a fuel outlet through which fuel is injected into a respective combustion chamber. A plunger is operable within a pumping chamber for filling the pumping chamber with fuel from the fuel inlet during charging of the pumping chamber and for forcing fuel from the pumping chamber during discharging of the pumping chamber. A first control valve is operable to selectively open and close the fuel outlet.

Each fuel injector also has a control fluid inlet at which control fluid is introduced into the fuel injector. A second control valve is selectively operable in timed relation to operation of the engine to allow control fluid to force the first control valve closed when fuel is not to be injected into the respective combustion chamber and to disallow control fluid from forcing the first control valve closed when fuel is to be injected into the respective combustion chamber. A third control valve is selectively operable in timed relation to operation of the engine to disallow control fluid from acting on the plunger when fuel is not to be injected into the respective combustion chamber and to act on the plunger for discharging fuel from the pumping chamber and forcing the first control valve open when the second control valve is disallowing control fluid from forcing the first control valve closed to cause fuel to be injected into the respective combustion chamber.

Still another generic aspect relates to a method of injecting fuel into a combustion chamber of an internal combustion engine within which fuel is compressed and combusted to power the engine. The method comprises charging a pumping chamber with fuel at a nominal pressure to create a fuel charge while a first control valve that is disposed in a passage between the pumping chamber and the combustion chamber is being forced closed by control fluid that is allowed to act on the first control valve by a second control valve. While the first control valve continues to be forced closed, the pressure of the fuel charge is amplified to a pressure greater than the nominal pressure.

Then the second control valve is operated to terminate the action of control fluid on the first control valve and allow the amplified fuel charge pressure to force the first control valve to open the passage from the pumping chamber to the combustion chamber. Finally the fuel charge is forced from the pumping chamber through the open passage to the combustion chamber.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
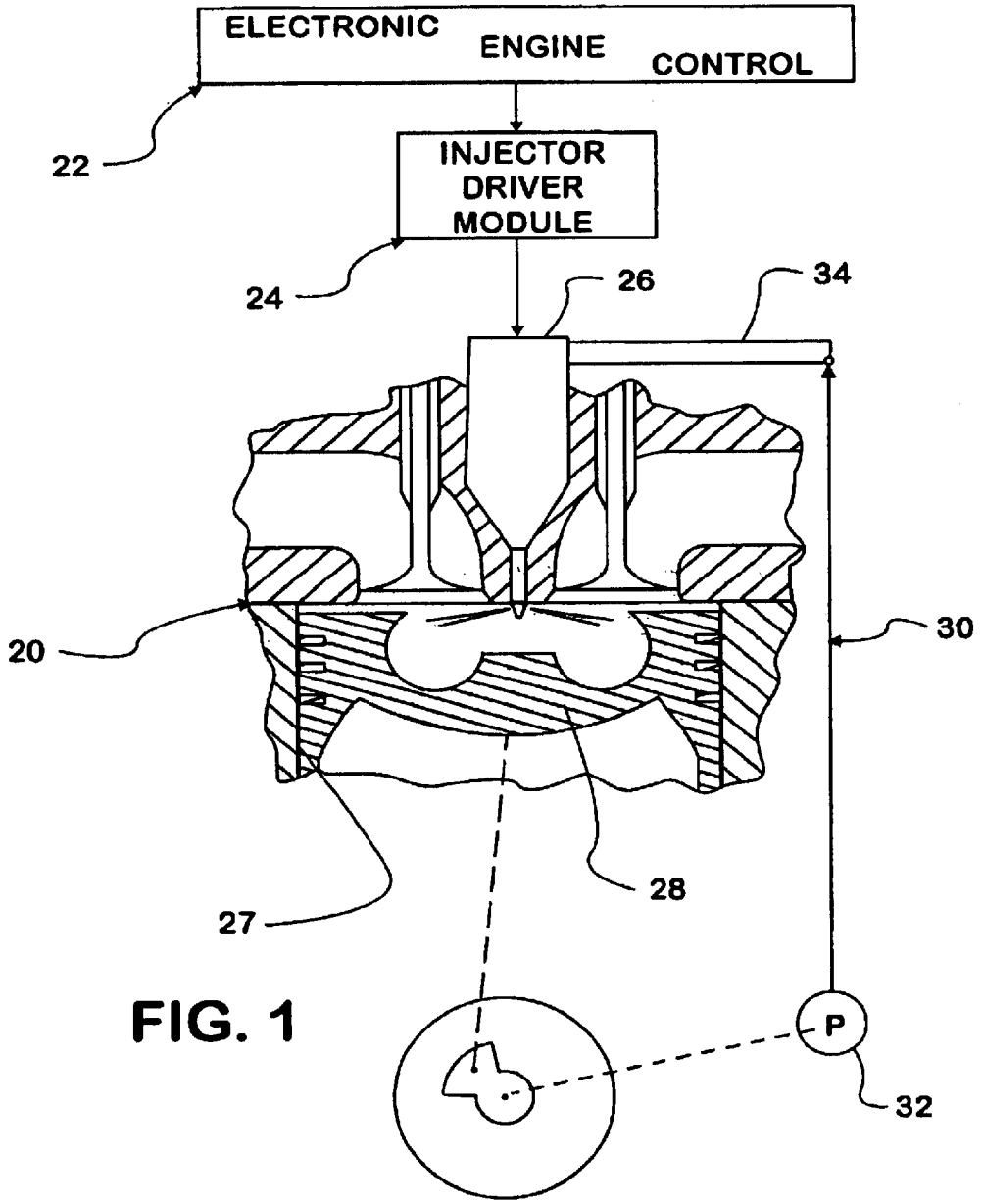
FIG. 1 is a general schematic diagram of a portion of an exemplary diesel engine relevant to an understanding of the invention.

FIG. 1 shows a schematic diagram of a portion of an exemplary diesel engine 20 relevant to an understanding of principles of the present invention. Engine 20 is used for powering a motor vehicle and comprises a processor-based engine control system 22 that processes data from various sources to develop various control data for controlling various aspects of engine operation. The data processed by control system 22 may originate at external sources, such as sensors, and/or be generated internally.

Control system 22 includes an injector driver module 24 for controlling the operation of electric-actuated fuel injection devices 26 embodying principles of the present invention. Each device 26 mounts on the engine in association with a respective engine combustion chamber illustrated by an engine cylinder 27 within which a piston 28 reciprocates. A processor of engine control system 22 can process data sufficiently fast to calculate, in real time, the timing and duration of device actuation to set both the timing and the amount of fueling.

Engine 20 further comprises an oil system 30 having a pump 32 for delivering oil under pressure to an oil rail 34 that serves in effect as a manifold for supplying oil, as a control fluid, to the individual devices 26.

Figure 2:
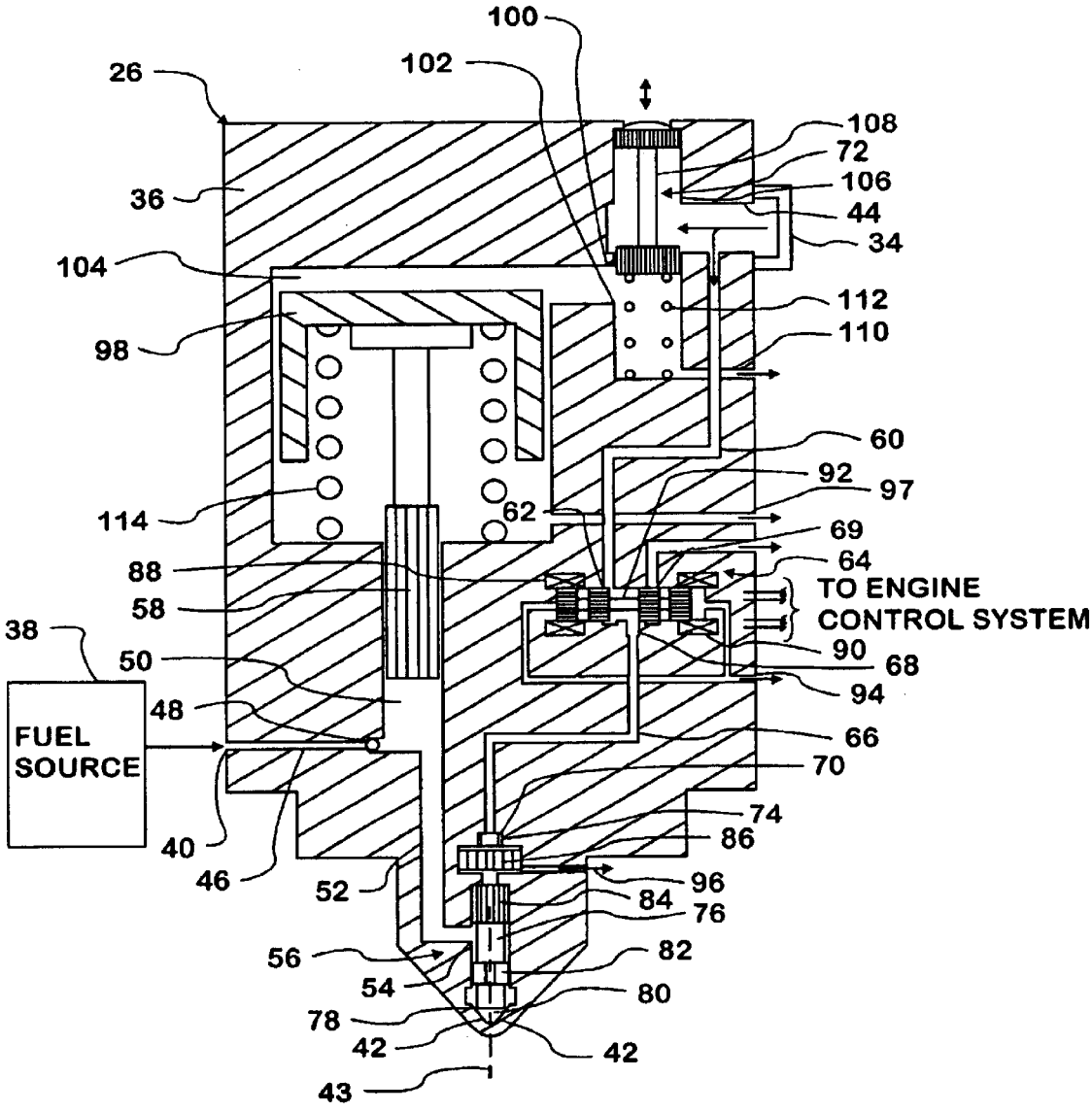
FIG. 2 is a cross section view through a fuel injection device embodying principles of the present invention and shown by itself.

FIG. 2 shows device 26 to comprise a body 36 that mounts on engine 20 in association with oil rail 34, a respective cylinder 27, and a source of fuel 38. Device 26 has an electrical connector that provides for connection with an electrical system of the vehicle that includes processor-based engine control system 22. Fuel source 38 is communicated to a fuel inlet port 40 in body 36. Device 26 further comprises a fuel outlet port 42 in body 36 that is open to cylinder 27, and a control fluid inlet port 44 that is communicated to oil rail 34. Outlet port 42 is shown by example as comprising several orifices arranged angularly about an imaginary axis 43.

A fuel passage 46 that contains a check valve 48 extends within body 36 to an internal bore forming a pumping chamber 50. A further fuel passage 52 extends from pumping chamber 50 to a port 54 of an outlet control valve 56 that, as will be more fully explained, is operable selectively to open outlet port 42 for allowing fuel to be injected from device 26 into cylinder 27 and to close outlet port 42 for disallowing fuel from being injected from device 26. Port 42 thus essentially forms another port of valve 56.

A plunger 58 is operable for reciprocal displacement within pumping chamber 50. During one portion of an engine cycle, plunger 58 executes a charge upstroke during which pumping chamber 50 fills with fuel from inlet port 40 while valve 56 is closed. During another portion of the engine cycle, plunger 58 executes a discharge downstroke to force fuel from the pumping chamber. The pumping of fuel from pumping chamber 50 during a downstroke of plunger 58 forces valve 56 to open passage 52 to outlet port 42 so that the fuel being forced out of the pumping chamber flows through passage 52 and valve 56 to exit device 26 through outlet port 42 and be injected into cylinder 27.

An oil passage 60 extends within body 36 from port 44 to a port 62 of another control valve 64 within body 36. Oil from rail 34 provides control fluid that is supplied to port 44 and delivered through passage 60 to valve 64. A further oil passage 66 extends within body 36 from another port 68 of valve 64 to a what is in essence a third port 70 of valve 56. Valve 64 is operable selectively to allow control fluid, i.e. oil, to force valve 56 closed for disallowing injection of fuel from outlet port 42 and to disallow control fluid from forcing valve 56 closed so that fuel is enabled to be injected into cylinder 27 from port 42.

Device 26 still further comprises a third control valve 72 that is operable selectively to allow control fluid introduced at port 44 to force plunger 58 to execute a discharge stroke while control valve 64 is disallowing control fluid from forcing control valve 56 closed and to disallow control fluid from preventing execution of a charge stroke so that plunger 58 can execute an upstroke during which fuel from supply 38 fills pumping chamber 50. Valve 72 is selectively operable in timed relation to operation of engine 20 to disallow control fluid from acting on plunger 58 when fuel is not to be injected into cylinder 27 and to act on plunger 58 for pumping fuel from pumping chamber 50 and forcing valve 42 open when valve 64 is disallowing control fluid from forcing valve 42 closed, thereby causing fuel to be injected into cylinder 27.

Valve 72 can, for example, be operated by an electro-hydraulic actuator, either rotary or linear, in the case of either a "camless" or "non-camless" engine, or from the camshaft mechanism of a "non-camless" engine. Although the drawing shows valve 72 as part of device 26, it could instead be placed inside oil rail 34 in appropriate situations.

Valve 56 comprises a spring 74 that resiliently biases a movable valve element 76 toward seating on a seat 78 that circumscribes outlet port 42 in closure of that port. Valve element 76 may be considered a needle valve that has a conically tipped end 80 that seats on seat 78 when the valve is closed. It has spaced apart lands 82, 84 that guide its motion within a bore in body 36 centered along axis 43.

Land 82 is non-circular to allow fuel to pass from port 54 to tipped end 80. Land 84 is intended to have a wet seal relationship to the surface of the portion of the bore within which it slides as element 76 is displaced within the bore. More interiorly of valve 56 is a needle-lock piston 86 that forms an interior end of valve element 76. It is on an end face of piston 86 that spring 74 acts, and that end face is also open to port 70 through a needle-lock piston control chamber within which spring 74 is disposed.

Valve 64 comprises first and second electric actuator elements 88, 90 for selectively positioning a linearly displaceable valve element 92 to a first position, as shown in FIG. 2, that allows control fluid to pass from port 62 to port 68 and then through passage 66 to act on piston 86 for forcing outlet control valve 56 closed and to a second position that prohibits flow from port 62 to port 68 to thereby disallow control fluid from acting on piston 86. When valve element 92 is in its second position, port 68 is open to a port 69 that leads to an oil sump of the oiling system.

Valve element 92 comprises a landed spool that is forced to the first position when the first and second electric actuator elements 88, 90 are energized in a first pattern of energization and that is forced to the second position when the first and second electric actuator elements are energized in a second pattern of energization. For securing fast response of the spool when the energization pattern changes, valve 64 lacks any bias spring acting on valve element 92.

Oil return passages 94, 96 extend in body 36 from appropriate locations at valves 64, 56 to return any leakage oil to the oil sump of the oiling system.

An intensifier piston 98 is operatively associated with plunger 58, and in fact the two may be fabricated as a single part. An oil passage 100 within body 36 communicates an outlet port 102 of valve 72 with the head end of a cylinder space 104 within which piston 98 is operable. An inlet port 106 of valve 72 is in communication with port 44. An oil return passage 107 returns any oil that leaks past piston 98 to the oil sump.

Valve 72 comprises a valve element 108 that is shown in FIG. 2 closing port 102 to port 106. When valve element 108 assumes the condition shown by FIG. 2 closing port 102 to port 106, oil cannot be delivered from port 44 past valve 72 to the head end of cylinder space 104. However, when valve element 108 is displaced to a condition that opens port 102 to port 106, oil is delivered through valve 72 and passage 100 to the head end of cylinder space 104 to act on the head of piston 98. An oil return passage 110 returns any leakage oil from valve 72 to the oil sump, and a spring 112 resiliently biases valve element 108 to the closed position illustrated by FIG. 2.

A spring 114 resiliently biases piston 98 in a sense that minimizes the volume of the head end of cylinder space 104, thereby also biasing plunger 58 in the direction of upstroking. An oil return passage 116 returns any oil that may leak past piston 98 to the oil sump.

Figure 3:
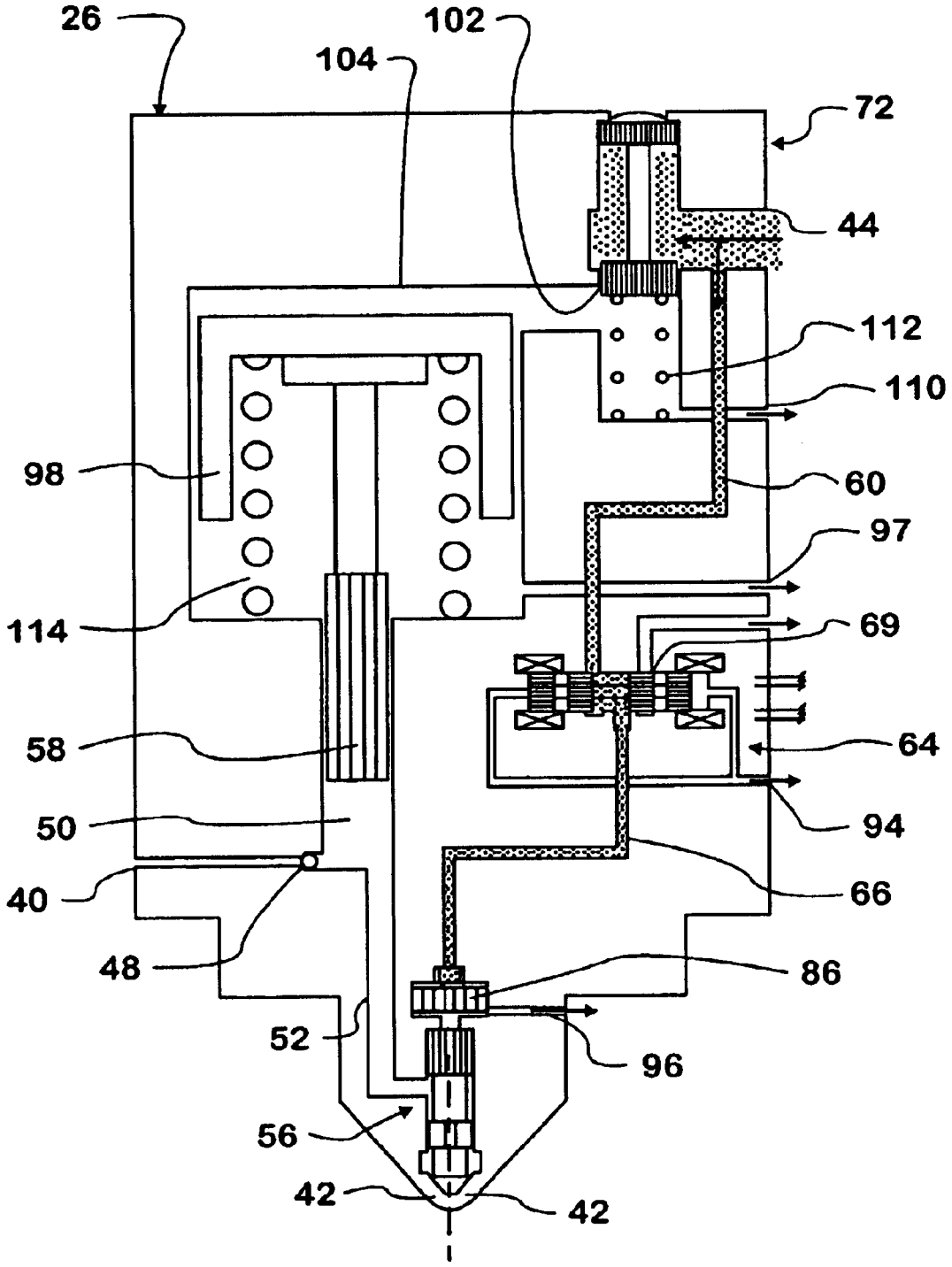
FIG. 3 is a cross section view through the same fuel injection device but in association with the engine during a portion of an engine cycle when the pumping chamber of the device is being charged with fuel preparatory to start of injection.

FIGS. 3–7 are essentially snapshots of device 26 at a succession of times during an engine cycle. FIG. 3 shows the device with pumping chamber 50 having been charged with fuel in preparation for an injection. Control valve 64 is being energized in a manner that forces it open, thereby allowing ICP to act on needle-lock piston 86 to force outlet control valve 56 closed. Control valve 72 is not being actuated, and is therefore being biased closed by spring 112, which is strong enough to resist the opposing force being exerted by ICP trying to open valve 72. Consequently, control fluid is not acting on piston 98.

Figure 4:
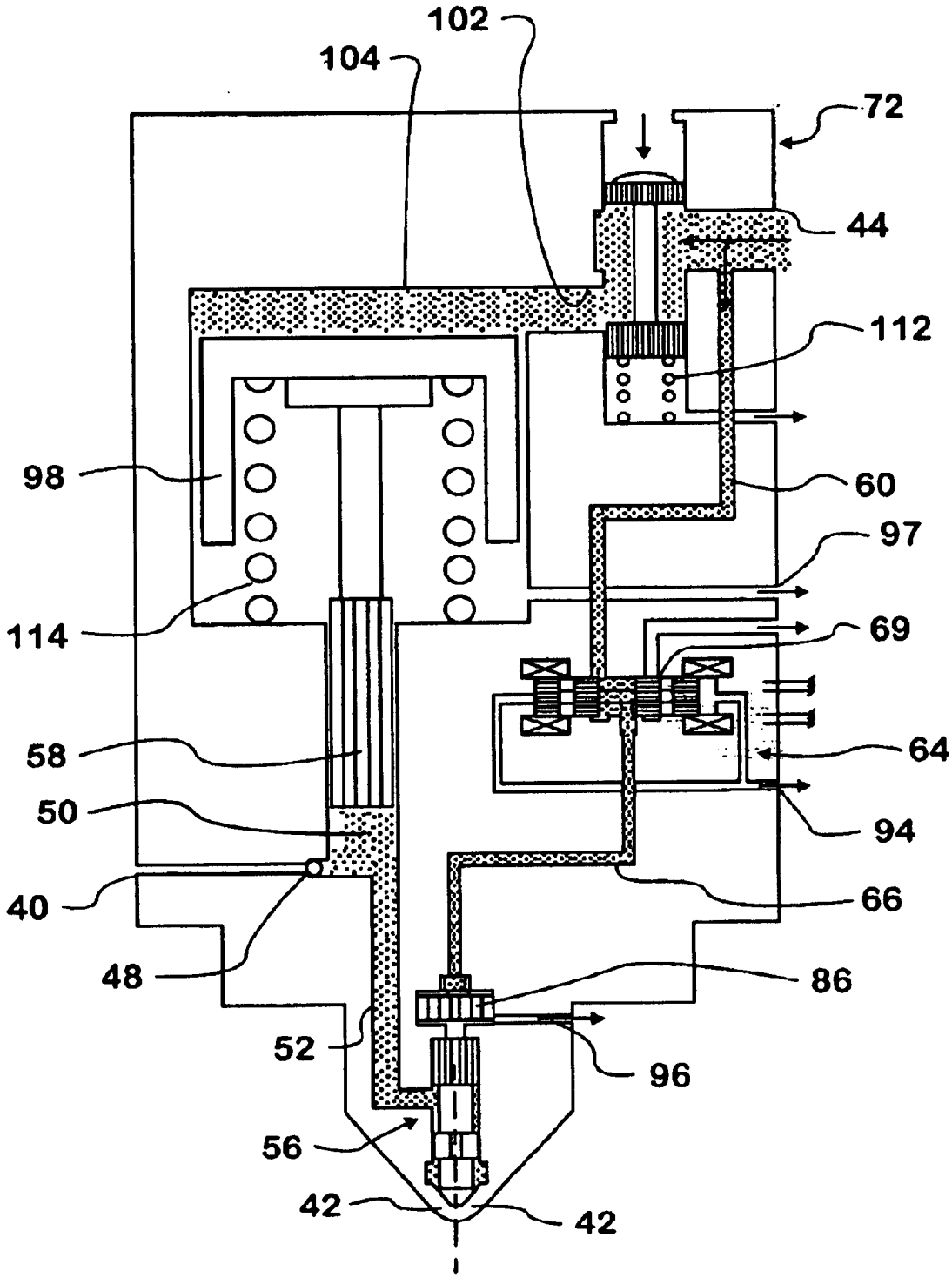
FIG. 4 is a cross section view similar to FIG. 3 at a later time in the engine cycle, but still before start of injection.

As the engine cycle approaches the time for a fuel injection, control valve 72 is operated open, as shown by FIG. 4, allowing control fluid to now act on piston 98. Fuel in pumping chamber 50 and passage 52 is trapped because it obviously cannot be forced back through check valve 48 and because control valve 56 continues to be forced closed by virtue of control valve 64 remaining open. With the area of piston 98 on which ICP acts being larger than the area of plunger 58 acting on fuel in pumping chamber 50, the pressure of fuel in pumping chamber 50 and passage 52 is amplified to a pressure that is essentially the ratio of those two areas multiplied by ICP.

Although that amplified fuel pressure may be acting on a surface area of valve element 76 in a manner that tries to open valve 56, the opposing force exerted by the combination of spring 74 and of the hydraulic force exerted on needle-lock piston 86 by ICP oil in the needle-lock piston control chamber keeps valve 56 closed not only as the fuel pressure is rising but also after maximum fuel pressure has been reached. In this regard the effective area of piston 86 on which ICP oil in the control chamber acts is sufficiently larger than any effective area of valve element 76 on which amplified fuel pressure may act to assure that valve 56 remains closed so long as valve 64 remains open.

Figure 5:
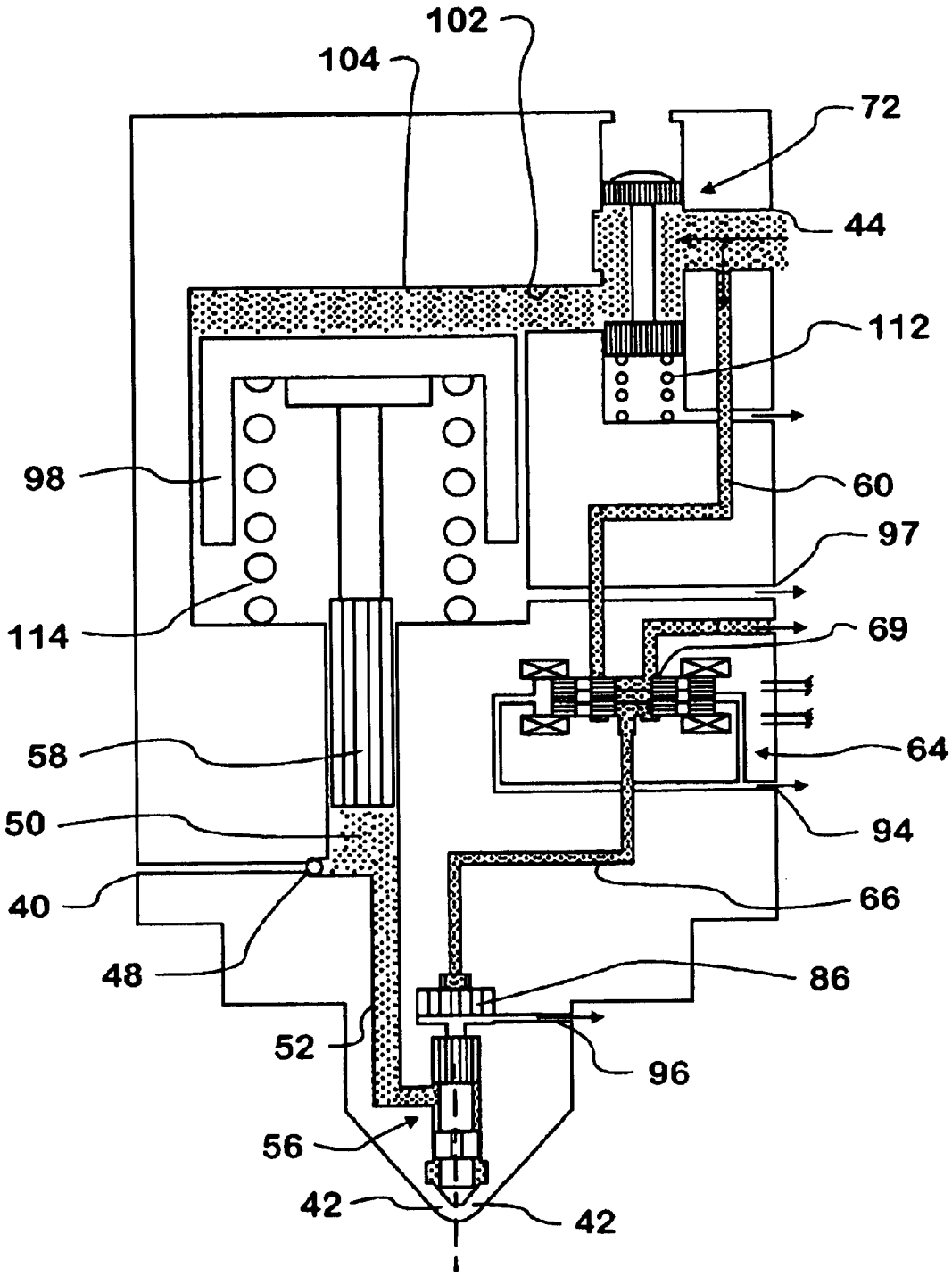
FIG. 5 is a cross section view similar to FIG. 4 just at start of injection.
Figure 6:
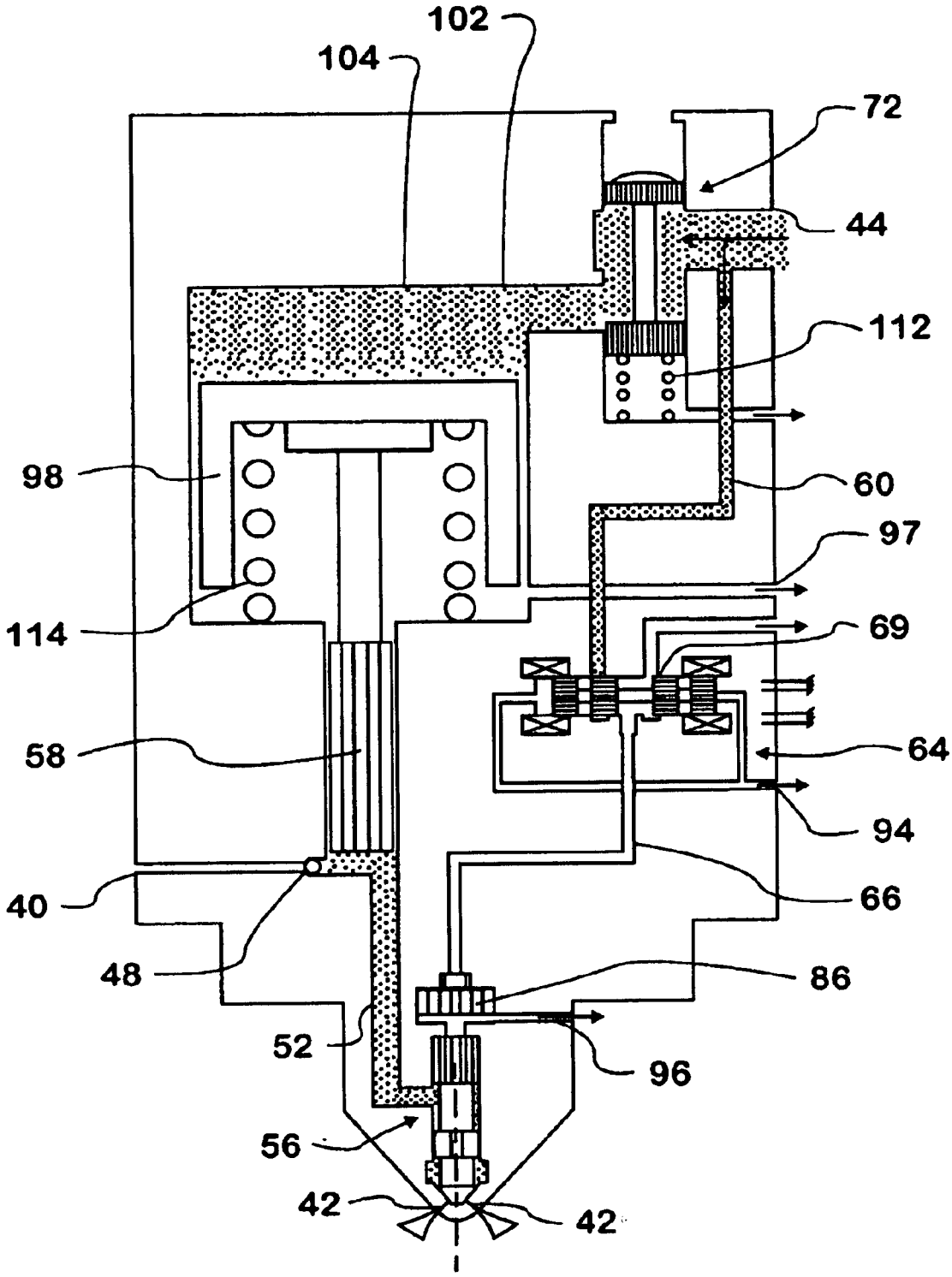
FIG. 6 is a cross section view similar to FIG. 5 during injection.
Figure 7:
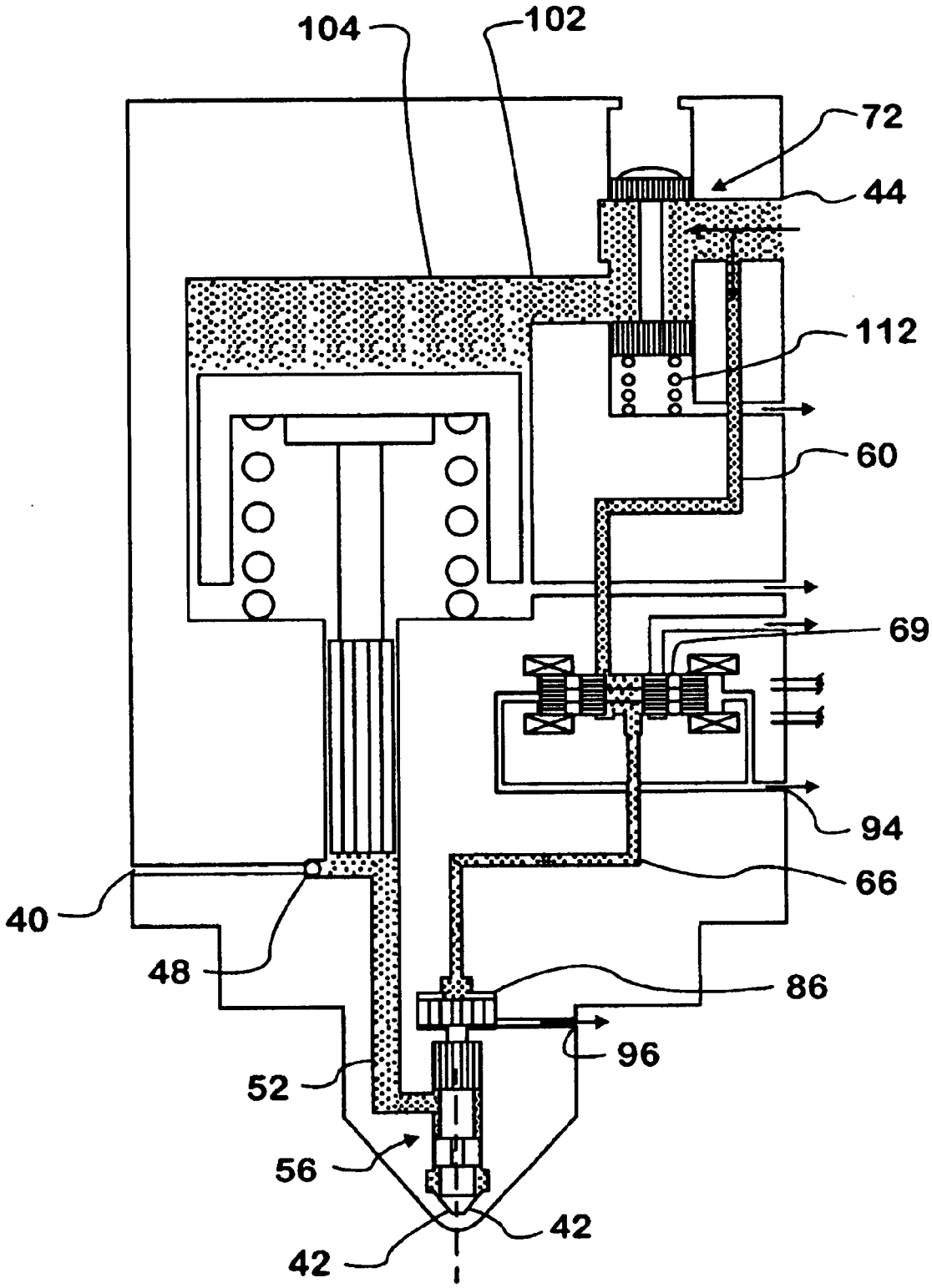
FIG. 7 is a cross section view similar to FIG. 6 at the conclusion of injection.

Once suitable amplified fuel pressure has been attained, actual injection occurs. FIG. 5 shows that the manner of energizing actuator elements 88, 90 has changed to cause valve 64 to close. This removes ICP oil pressure from the needle-lock piston control chamber, thereby allowing the amplified fuel pressure to force valve 56 open. The continuing application of ICP to piston 98 forces a downstroke of plunger 58 and the expulsion of fuel from pumping chamber 50, through passage 52 and the now-open valve 56, and out of device 26 through outlet port 42 and into cylinder 27, as represented by FIG. 6.

Injection is terminated by energizing actuator elements 88, 90 in the manner that causes valve 64 to once again open. By re-opening valve 64 as plunger continues to downstroke, the pressure of fuel being injected is maintained substantially at amplified pressure proportional to ICP throughout the injection, virtually to the very end of injection. That factor, coupled with valve 64 being "fast-acting", enables timing and amount of fuel injected to be well-controlled.

After the injection has concluded, valve 72, which had remained open during the injection, returns to its closed condition, removing the application of ICP from piston 98. The combined force of spring 114 and nominal fuel pressure then forces piston 98, and hence plunger 58 also, to upstroke, with resulting motion of the plunger allowing pumping chamber 50 to fill with new fuel from fuel source 38 in preparation for injection during the next engine cycle.

By providing separate control valves 72, 64 for controlling the application of ICP oil to the pumping mechanism and to needle-lock piston control chamber, the design of each valve 72, 64 can be optimized for the particular function that it performs. Valve 72 can be a "slow-acting" control valve that has a larger open flow area and need not operate as fast as control valve 64. By allowing the "slow-acting" control valve to fully open before start of injection, fuel pressure is amplified to a suitable pressure before start of injection, and once injection starts, the entire injection can take place while fuel pressure is maintained substantially at the amplified pressure because the larger open flow area imposes relatively small restriction to flow of oil from the oil rail to the plunger. The beginning and ending of injection can be closely controlled because valve 64 is "fast-acting" by virtue of its small mass and the small amount of oil needed to operate it, and because a large closing force can be exerted via needle-lock piston 86 with relatively small displacement of valve member 76 being needed.

Figure 8:
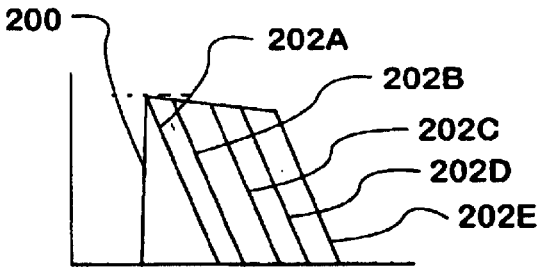
FIG. 8 is a trace showing how the device can create a single injection having different durations.

FIG. 8 is a trace showing how the fuel injection device can create a single injection having different durations. The leading edge 200 represents the beginning of all the injections. The succession of five trailing edges 202A, 202B, 202C, 202D, 202E represents the various durations.

Figure 9:
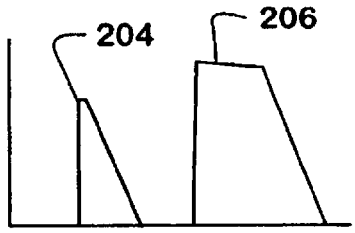
FIG. 9 is a trace showing how the device can create distinct pilot and main injections.

FIG. 9 is a trace showing how the device can create distinct pilot and main injections 204, 206.

Figure 10:
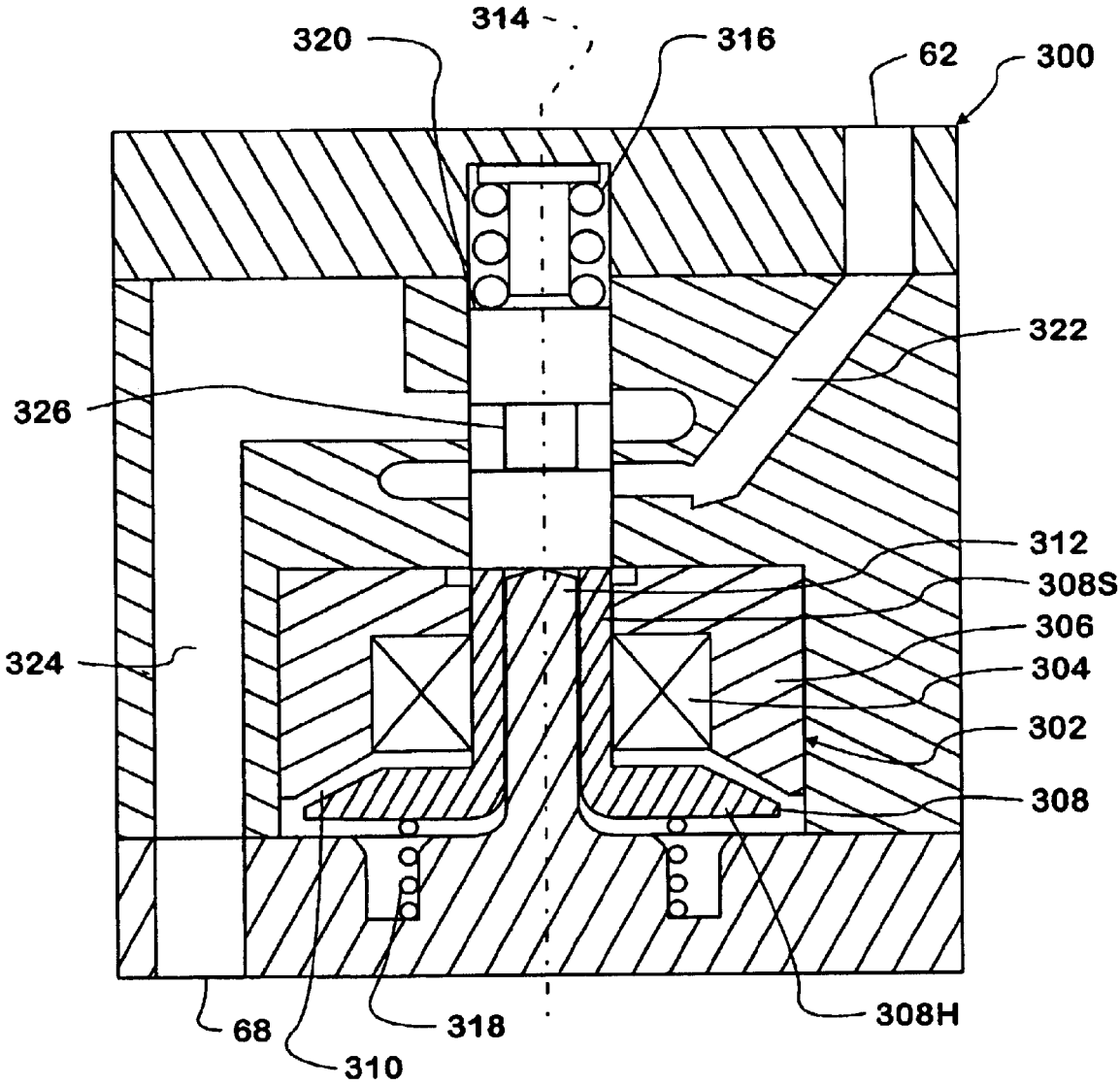
FIG. 10 is a longitudinal cross section view through an example of a fast-acting valve through which oil flows to a needle-lock piston control chamber of the device.
Figure 11:
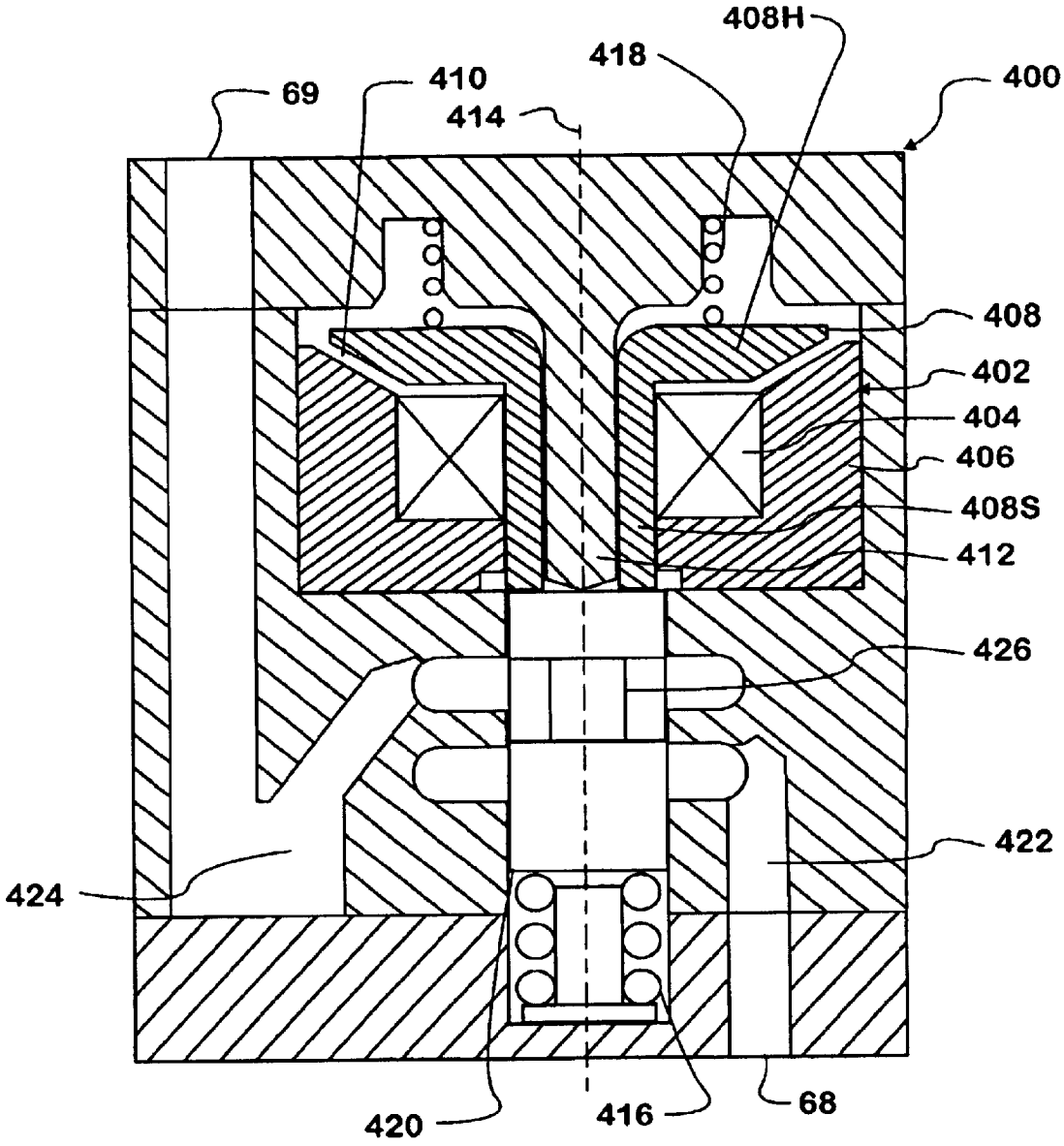
FIG. 11 is a longitudinal cross section view through an example of a fast-acting valve through which oil flows from the needle-lock piston control chamber.

FIGS. 10 and 11 show examples of two valves 300, 400 that collectively function in the same manner as valve 64. Ports 62, 68, and 69 are marked as shown. Each valve is essentially a two-way, two-position, solenoid-actuated, spring-return, spool valve. The respective solenoids 302, 402 comprise respective coils 304, 404 having associated stators 306, 406. A respective armature 308, 408 is associated with a respective stator. Each armature comprises a head 308H, 408H and a stem 308S, 408S.

When the coils are not energized, the perimeter of the head 308H, 408H of a respective armature 308, 408 is spaced a short distance from a perimeter of the respective stator by a respective air gap 310, 410. Each stem 308S, 408S is hollow and serves to guide the respective armature for motion on a respective post 312, 412 along a respective axis 314, 414. Each post extends from a respective end wall of the valve body Each valve further comprises a respective relatively stronger spring 316, 416, and a respective relatively weaker spring 318, 418. The stronger spring acts at one end of a respective valve spool 320, 420 to resiliently bias the respective spool in a sense along the respective axis 314, 414 that forces the outer perimeter margin of the opposite end of the spool against the free end of the respective post 312, 412. The weaker spring acts to resiliently bias the respective armature in a sense along the respective axis 314, 414 that forces the free end of the respective stem 308S, 408S against a central zone of the end of the respective spool that is being forced the end of the respective stem by the respective stronger spring. Each spool fits closely within a respective bore in the valve body and is guided by the bore for motion along the respective axis 314, 414.

When coil 304 is not being energized, the dominant force exerted by spring 316 forces spool 320 to abut the end of post 312. The weaker spring 318 is acting on armature 308 to keep the free end of stem 308S against the spool. An axially central zone of spool 320 is thereby positioned to allow communication between an internal passage 322 extending from port 62 to the spool bore and an internal passage 324 extending from port 68 to the spool bore. The axially central zone of spool 320 comprises a circular groove 326 that provides communication between passages 322 and 324 when coil 304 is not energized.

When coil 304 is energized, the bias of spring 316 is overcome by the electromagnetic force and spool 320 is displaced a short distance, upward in the drawing, to position groove 326 so that it no longer provides communication between passages 322 and 324, thereby closing port 62 to port 68. Because of the strategic location of groove 326, the spool need move only a short distance to establish the communication. That is one factor in making the valve "fast-acting". Other factors are the ability to rapidly develop relatively large electromagnetic force when the coil is energized, and relatively small mass for the spool. When coil 304 ceases to be energized, spring 316 quickly forces the spool to once again allow the communication between passages 322 and 324.

When coil 404 is not being energized, the dominant force exerted by spring 416 forces spool 420 to abut the end of post 412. The weaker spring 418 is acting on armature 408 to keep the free end of stem 408S against the spool. An axially central zone of spool 420 is thereby positioned to block communication between an internal passage 422 extending from port 68 to the spool bore and an internal passage 424 extending from port 69 to the spool bore. Adjacent the portion of its central zone that is blocking communication between passages 422 and 424, spool 420 comprises a circular groove 426.

When coil 404 is energized, the bias of spring 416 is overcome by the electromagnetic force and spool 420 is displaced a short distance, downward in the drawing, to position groove 426 so that it allows communication between passages 422 and 424, thereby opening port 68 to port 69. Because of the strategic location of groove 426, the spool need move only a short distance to establish the communication. The same factors that make valve 300 "fast-acting" also make valve 400 "fast-acting". When coil 404 ceases to be energized, spring 416 quickly forces the spool to block the communication between the two passages 422 and 424.

Figure 12:
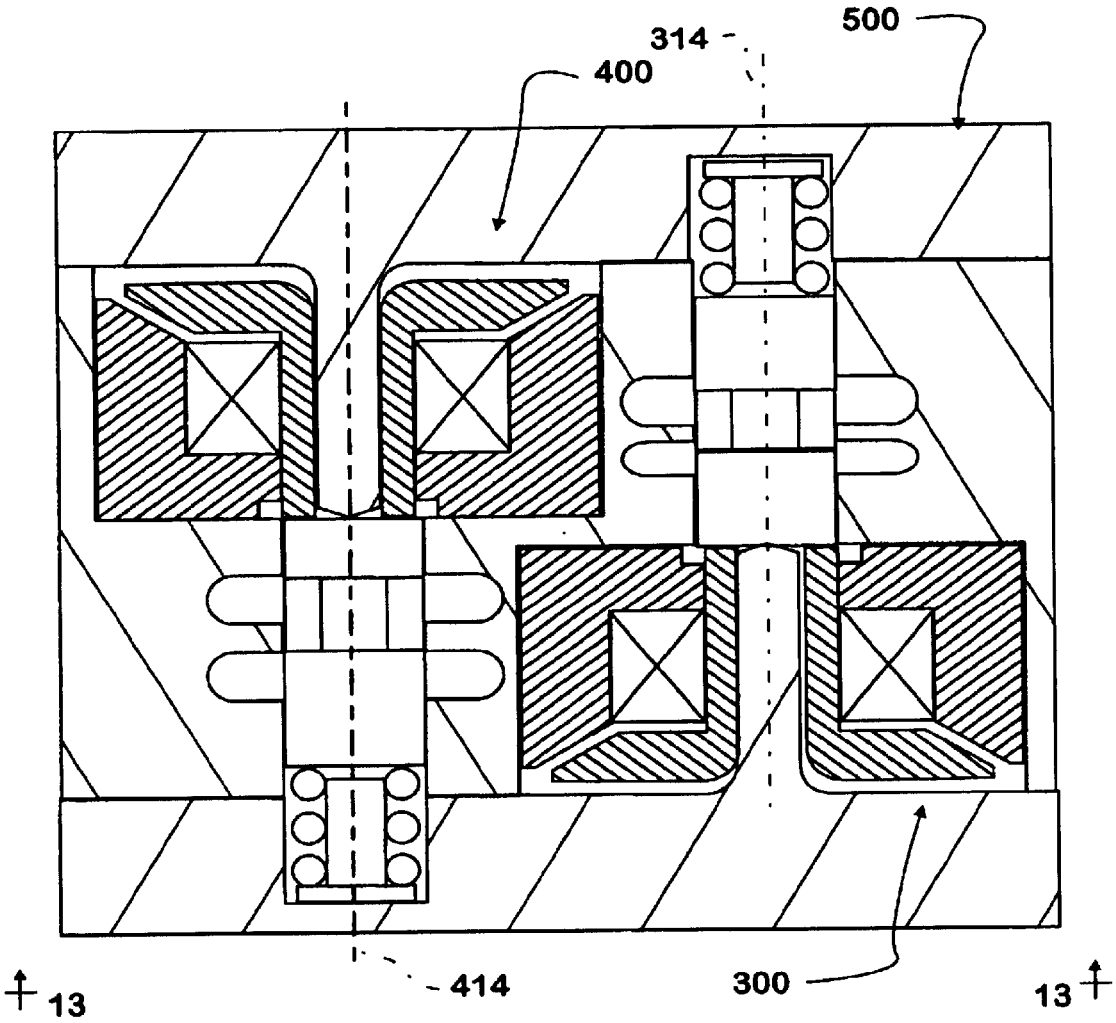
FIG. 12 is a longitudinal cross section view illustrating the integration of the valves of FIGS. 10 and 11 in a control valve.
Figure 13:
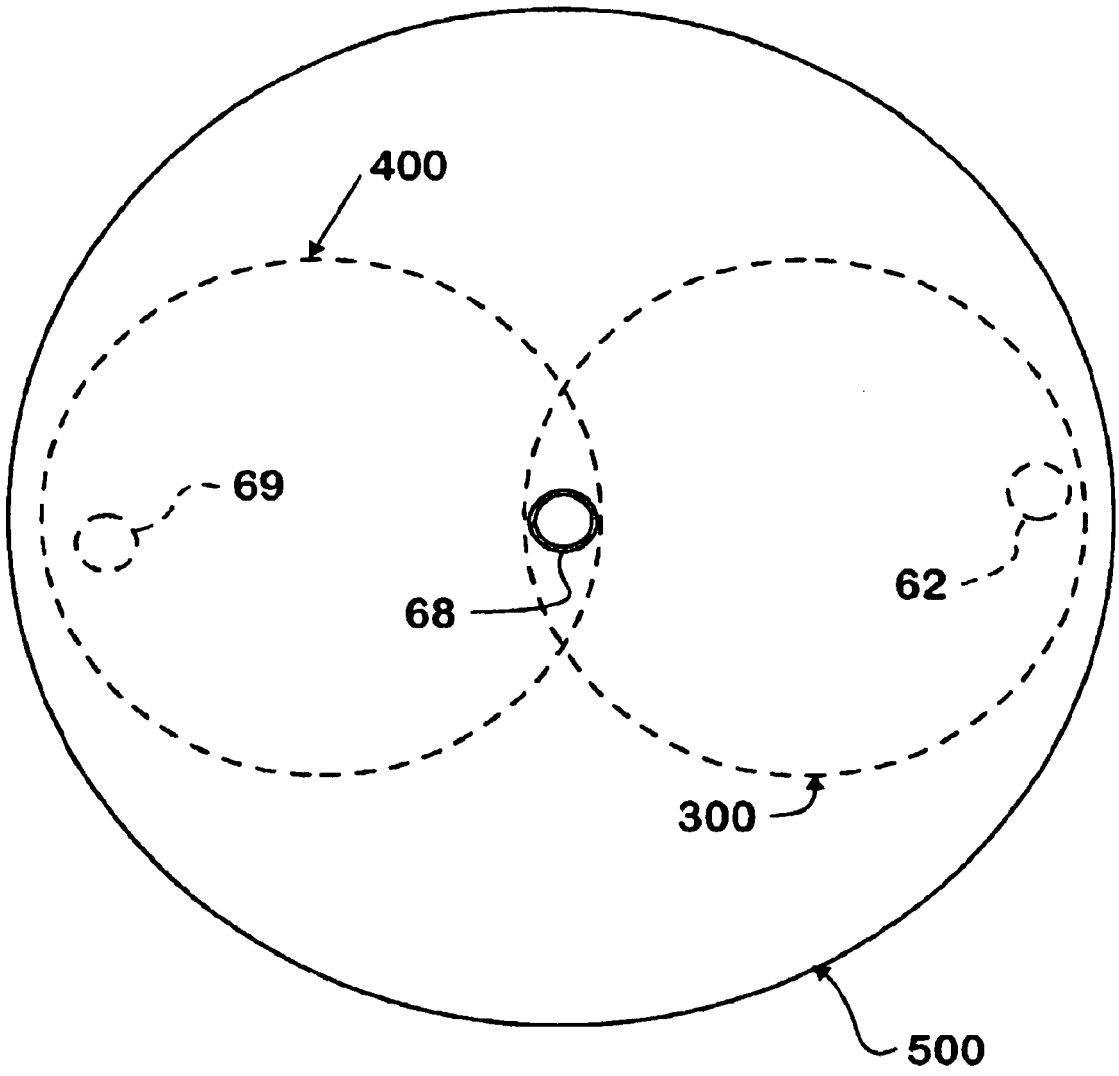
FIG. 13 is a bottom view of FIG. 12.
Figure 14:
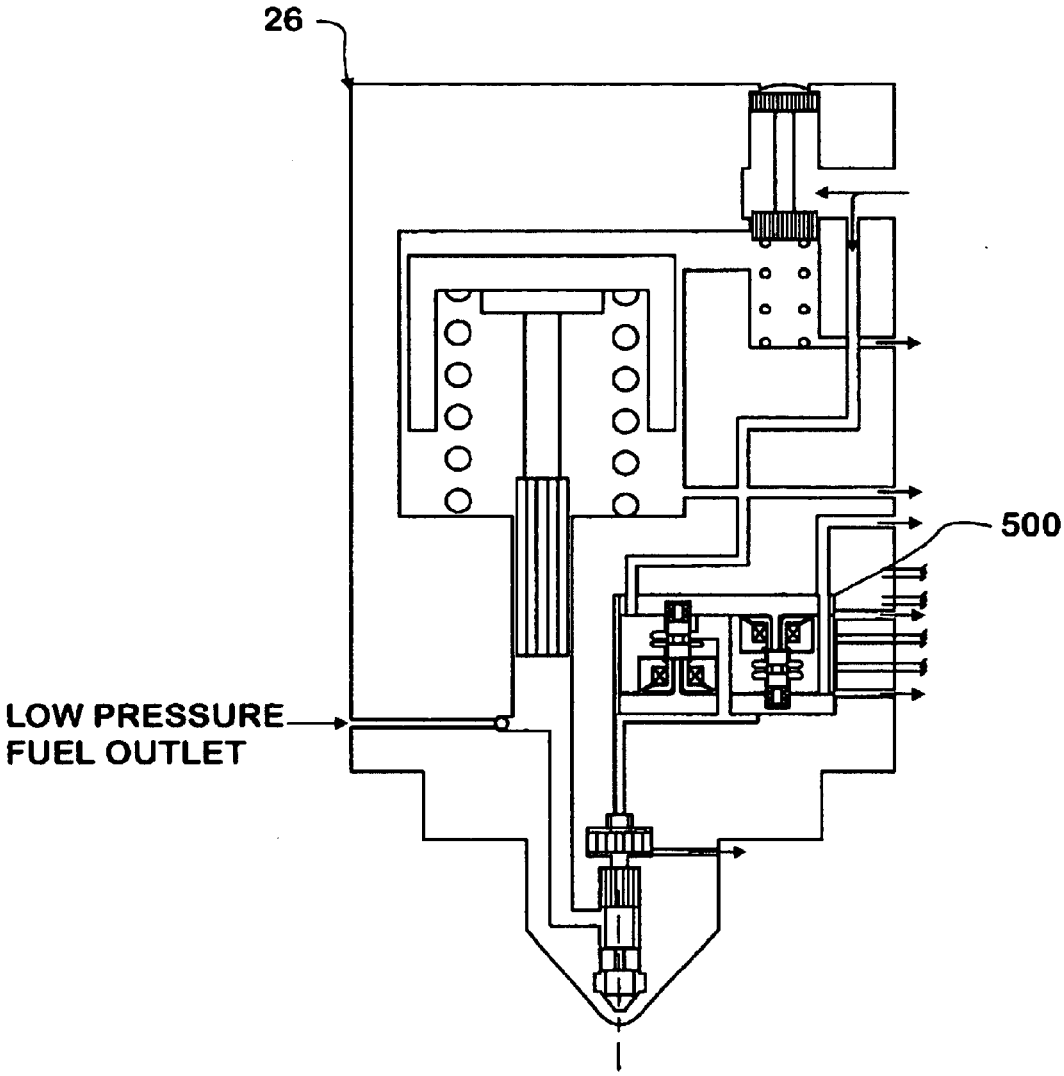
FIG. 14 is a cross section view through another fuel injection device embodying the control valve of FIGS. 12 and 13.

The specific valve designs shown in FIGS. 10 and 11 enable the two valves to be efficiently integrated into a single control valve 500, as depicted by FIGS. 12 and 13. In such an incorporation, the two separate ports 68 in FIGS. 10 and 11 become one. FIG. 14 shows a fuel injection device 26 like the one in FIG. 2 except for control valve 64 being replaced by control valve 500.

The "fast-acting" capability of valve 64 contributes to fast operation of needle valve element 76. The latter element is also designed in its own right for fast action. The ability to quickly drop oil pressure being applied to needle-lock piston 86 enables the needle valve element to quickly lift. Such quick lifting minimizes the time interval during which the injected fuel is being restricted as the valve element lifts. Similarly, the ability to quickly increase oil pressure to needle-lock piston 86 enables the needle valve element to quickly close, minimizing the time interval during which the injected fuel is being restricted as the valve element closes.

In addition to the control valve 500 described for FIGS. 10–13 and the control valve 64 shown in FIG. 2, another possible "fast-acting" configuration comprises a three-way, two-position spool valve having one solenoid and one or more springs.

A linear spool valve, hydraulically balanced, and a rotary spool valve are two types suitable for "slow-acting" valve 72. The valves are designed to relatively slowly build pressure in cylinder space 104 as they open, thereby relatively slowly amplifying the fuel pressure to a pressure suitable for injection, and once the pressure has been built, to present negligible restriction to the flow that operates piston 98 to force the injection.

While a presently preferred embodiment of the invention has been illustrated and described, it should be appreciated that principles of the invention apply to all embodiments falling within the scope of the following claims.

What is claimed is:

1. A device for injecting fuel into a combustion chamber of an internal combustion engine comprising:

a fuel inlet through which fuel is introduced into the device;

a fuel outlet through which fuel is injected from the device;

a first control valve operable selectively to open the fuel outlet for allowing fuel to be injected from the device and to close the fuel outlet for disallowing fuel from being injected from the device;

a plunger operable within a pumping chamber that has fluid communication with both the fuel inlet and the first control valve for executing a charge stroke to fill the pumping chamber with fuel from the fuel inlet while the first control valve is closed, and thereafter a discharge stroke that forces fuel from the pumping chamber to open the first control valve to the fuel outlet and be injected from the fuel outlet;

a control fluid inlet at which control fluid, other than fuel, is introduced into the device;

a second control valve that is operable selectively to a first position to cause control fluid to force the first control valve closed and thereby disallow injection of fuel from the fuel outlet and to a second position to disallow control fluid from forcing the first control valve closed and thereby cause injection of fuel from the fuel outlet; and a third control valve that is operable selectively to allow control fluid to force the plunger to execute a discharge stroke while the second control valve is disallowing control fluid from forcing the first control valve closed and to disallow control fluid from preventing execution of a charge stroke;

wherein the first control valve comprises three ports, a first of which is in fluid communication with the pumping chamber, a second of which forms the fuel outlet, and a third of which is in fluid communication with the second control valve, a spring that resiliently biases a movable valve element toward seating on a seat that circumscribes the second port in closure of the fuel outlet, and wherein control fluid that the second control valve allows to force the first control valve closed is communicated to the third port of the first control valve to force the movable valve element toward seating on the seat, the movable valve element comprises a first surface on which control fluid communicated to the third port of the first control valve acts to force the movable valve element toward seating on the seat and a second surface on which fuel that is communicated to the first port of the first control valve acts to urge the movable valve element away from seating on the seat, wherein the first surface of the movable element comprises an effective area larger than an effective area of the second surface and is disposed within a chamber within which the spring is also disposed to bear against the first surface for resiliently biasing the movable valve element toward seating on the seat, and a fluid passage that extends from the second control valve to the chamber through which fluid passage control fluid is communicated to the first surface when the second valve control valve is in the first position and through which the control fluid that had been communicated to the first surface is drained when the second valve control valve is in the second position.

2. A device as set forth in claim 1 wherein the plunger includes an intensifier piston on which control fluid acts to cause the plunger to execute a discharge stoke.

3. A device as set forth in claim 1 wherein the second control valve comprises first and second electric actuator elements for selectively positioning a movable valve element of the second control valve to the first position and to the second position.

4. A device as set forth in Claim 3 wherein the movable valve element of the second control valve comprises a valve spool that is forced to the first position when the first and second electric actuator elements are energized in a first pattern of energization and that is forced to the second position when the first and second electric actuator elements are energized in a second pattern of energization.

5. An internal combustion engine comprising:

combustion chambers in which fuel is compressed and combusted to power the engine;

fuel injectors for injecting fuel into the combustion chambers;

each fuel injector comprising A) a fuel inlet through which fuel is introduced into the fuel injector and a fuel outlet through which fuel is injected into a respective combustion chamber, B) a plunger operable within a pumping chamber for filling the pumping chamber with fuel from the fuel inlet during charging of the pumping chamber and for forcing fuel from the pumping chamber during discharging of the pumping chamber, C) a first control valve operable to selectively open and close the fuel outlet, D) a control fluid inlet at which control fluid, other than fuel, is introduced into the fuel injector, E) a second control valve selectively operable in timed relation to operation of the engine to a first position to cause control fluid to force the first control valve closed when fuel is not to be injected into the respective combustion chamber and to a second position to disallow control fluid from forcing the first control valve closed and thereby cause fuel to be injected into the respective combustion chamber; and E) a third control valve that is selectively operable in timed relation to operation of the engine to disallow control fluid from acting on the plunger when fuel is not to be injected into the respective combustion chamber and to act on the plunger for discharging fuel from the pumping chamber and forcing the first control valve open when the second control valve is disallowing control fluid from forcing the first control valve closed to cause fuel to be injected into the respective combustion chamber;

wherein the first control valve comprises three ports, a first of which is in fluid communication with the pumping chamber, a second of which forms the fuel outlet, and a third of which is in fluid communication with the second control valve, a spring that resiliently biases a movable valve element toward seating on a seat that circumscribes the second port in closure of the fuel outlet, and wherein control fluid that the second control valve allows to force the first control valve closed is communicated to the third port of the first control valve to force the movable valve element toward seating on the seat, the movable valve element comprises a first surface on which control fluid communicated to the third port of the first control valve acts to force the movable valve element toward seating on the seat and a second surface on which fuel that is communicated to the first port of the first control valve acts to urge the movable valve element away from seating on the seat, wherein the first surface of the movable clement comprises an effective area larger than an effective area of the second surface and is disposed within a chamber within which the spring is also disposed to bear against the first surface for resiliently biasing the movable valve element toward seating on the seat, and a fluid passage that extends from the second control valve to the chamber through which fluid passage control fluid is communicated to the first surface when the second valve control valve is in the first position and through which the control fluid that had been communicated to the first surface is drained when the second valve control valve is in the second position.

6. An internal combustion engine as set forth in claim 5 wherein the plunger includes an intensifier piston on which control fluid acts to force the plunger to discharge fuel from the pumping chamber.

7. An internal combustion engine as set forth in claim 5 wherein the second control valve comprises first and second electric actuator elements for selectively positioning a movable valve element of the second control valve to a first position that allows control fluid to act on the first control valve and to a second position that disallows control fluid from acting on the first control valve.

8. An internal combustion engine as set forth in claim 7 wherein the movable valve element of the second control valve comprises a valve spool that is forced to the first position when the first and second electric actuator elements are energized in a first pattern of energization and that is forced to the second position when the first and second electric actuator elements are energized in a second pattern of energization.

9. An internal combustion engine as set forth in claim 5 wherein operation of the second and third control valves for causing an injection of fuel is timed to cause the third control valve to allow control fluid to act on the plunger before the second control valve disallows control fluid from forcing the first control valve closed.

10. An internal combustion engine as set forth in claim 9 wherein the third control valve comprises a larger flow area for control fluid to pass through when maximally open than the second control valve when maximally open.

* * * * *